US005112004A

United States Patent [19]

Tipton

[11] Patent Number: 5,112,004

[45] Date of Patent: May 12, 1992

[54] STRAP DISPENSING AND ACCUMULATING APPARATUS AND COMBINATION OF SAME WITH STRAPPING MACHINE

[75] Inventor: Allison D. Tipton, Bloomingdale, Ill.

[73] Assignee: Illinois Tool Works Inc., Glenview, Ill.

[21] Appl. No.: 610,434

[22] Filed: Nov. 7, 1990

[51] Int. Cl.[5] ..... B65H 20/24; B65H 20/40

[52] U.S. Cl. ..... 242/75.51; 242/75.52; 242/105; 226/44; 226/45; 292/101; 292/202; 403/330

[58] Field of Search ..... 242/75.51, 75.52, 105, 242/75, 75.5; 226/45, 44; 403/330; 292/105, 206, 101, 202

[56] References Cited

U.S. PATENT DOCUMENTS

| | | | |
|---|---|---|---|
| 2,135,105 | 11/1938 | Knauff | 292/206 |
| 2,352,437 | 6/1944 | Howard | 292/101 |
| 2,993,659 | 7/1961 | Johnson | 242/75.2 |
| 3,074,661 | 1/1963 | Brumbaugh et al. | 226/45 |
| 3,137,426 | 6/1964 | Brenneisen | 226/10 |
| 3,177,749 | 4/1965 | Best et al. | 242/75.51 |
| 3,946,921 | 3/1976 | Noguchi | 226/43 |
| 3,966,245 | 6/1976 | Losenno | 292/202 |
| 4,364,503 | 12/1982 | Ivary et al. | 226/45 |
| 4,500,043 | 2/1985 | Brown | 226/45 |
| 4,557,427 | 10/1985 | Johnson | 242/105 |
| 4,577,837 | 3/1986 | Berg et al. | 403/330 |
| 4,651,944 | 3/1987 | Bader, Jr. | 242/75.5 |
| 4,669,766 | 6/1987 | Hanchett, Jr. et al. | 292/251.5 |
| 4,938,009 | 7/1990 | Takami | 242/75.2 |
| 4,978,244 | 12/1990 | Lange | 403/330 |

*Primary Examiner*—Daniel P. Stodola
*Assistant Examiner*—John Q. Nguyen
*Attorney, Agent, or Firm*—Schwartz & Weinrieb

[57] ABSTRACT

Strap dispensing and accumulating apparatus including a device for feeding strap from a strap supply to a strapping machine and an accumulator for accumulating strap being fed forwardly from the strap supply or being pushed backwardly by means of tensioning rollers of the strapping machine. A stretch-out box has an inlet, an outlet, and a lower wall. When pivoted to one position, a strap guide coacts with the lower wall, and with other elements, so as to define a channel for the strap between the inlet and the outlet. A detecting device is arranged to deactuate the feeding device when strap accumulating within the stretch-out box reaches a predetermined level. A flexible chute guides the strap from the outlet to a strapping head of the strapping machine. A combination of such apparatus with a strapping machine having a strapping head is disclosed.

20 Claims, 3 Drawing Sheets

STRAP DISPENSING AND ACCUMULATING APPARATUS AND COMBINATION OF SAME WITH STRAPPING MACHINE

TECHNICAL FIELD OF THE INVENTION

This invention pertains to strap dispensing and accumulating apparatus and to a combination comprising a strapping machine having a strapping head and such dispensing and accumulating apparatus.

BACKGROUND OF THE INVENTION

Strapping machines, which include strapping heads, are in widespread use for applying straps of thermoplastic material, such as, for example, polyester or polypropylene, in tensioned loops around packages. Typically, a strapping head of a strapping machine draws portions of a strap of such material of an indeterminate length into the strapping machine and feeds the strap around a package by means of a strap chute, whereupon the strapping head tensions the strap in a tensioned loop around the package, welds the strap in the tensioned loop state, and severs the strap forming the tensioned loop from the residual portions of the strap disposed upstream of the tensioned loop. Well known models of such strapping machines having such strapping heads are available commercially from Signode Industry Packaging Systems (a division of Illinois Tool Works Inc.) of Glenview, Ill. under its SIGNODE TM trademark, as exemplified by means of SIGNODE TM SPIRIT TM strapping machines.

Typically, the strapping head draws portions of the strap forwardly into the strapping machine when feeding the strap around the package and draws portions of the strap backwardly past the strapping head and in the direction away from the strapping machine when tensioning the strap. Commonly, a strap accumulator is used to accumulate portions of the strap drawn from a strap dispenser before portions of the strap are drawn by means of the strapping head into the strapping machine from the strap accumulator, and to accumulate portions of the strap drawn from the strapping machine back to the strap accumulator.

A strap accumulator, which may also be called a stretch-out box, is exemplified in Bader, Jr., U.S. Pat. No. 4,651,944. Other strap accumulators or similar devices are disclosed in Noguchi U.S. Pat. No. 3,946,921 and Brenneisen U.S. Pat. No. 3,137,426.

There has been a need, to which this invention is addressed, for improvements in strap dispensing and accumulating apparatus, which may be advantageously combined with a strapping machine within a strapping system.

SUMMARY OF THE INVENTION

This invention provides strap dispensing and accumulating apparatus of an improved design including, among other features, a strap guide providing enhanced utility to such apparatus.

Such dispensing and accumulating apparatus can be effectively used with a strap of thermoplastic material, such as, for example polyester or polypropylene, and with a strapping machine of a known type having a strapping head operable at certain times to draw portions of the strap forwardly into the strapping machine and at other times to draw portions of the strap backwardly out from the strapping machine. Specifically, the strap accumulator is useful to accumulate portions of the strap before portions of the strap are drawn by means of the strapping head into the strapping machine, to accumulate portions of the strap drawn by means of the strapping head out from the strapping machine, and to dispense accumulated strap portions to the strapping head.

Broadly, such dispensing and accumulating apparatus comprises a stretch-out box having a strap inlet and a strap outlet, a strap guide, and a mechanism for feeding an indeterminate amount of the strap from a supply of the strap into the stretch-out box, through means of the strap inlet. The stretch-out box includes two side walls in parallel relation with respect to each other and a lower wall defining a guiding surface between the strap inlet and the strap outlet. The strap guide is disposed between the side walls and is movable between a lower, operative position and an upper, inoperative position. The strap guide has a guiding surface, which overlies the guiding surface of the lower wall when the strap guide is disposed in the lower position. The strap guide, when disposed in the lower position coacts with the lower wall, along with the side walls, so as to define a channel between the guiding surfaces for guiding a strap being fed into the stretch-out box, through means of the strap inlet.

Preferably, the strap guide is an elongate member having two opposite ends and is pivotally mounted between the side walls of the stretch-out box, near the strap outlet, for pivotal movement about an axis near one of its opposite ends. The strap guide is pivotable, therefore, between the upper and lower positions. Preferably, moreover, such dispensing and accumulating apparatus comprises a device for releasably retaining or holding the strap guide in the upper position. The holding or retaining device may be a magnetic device, whereupon one of the side walls may have an aperture enabling a user to manually release the strap guide from the raised position, such as, for example, by inserting his or her finger or a small tool into the aperture so as to engage the strap guide and thereby forcefully disengage the same from the holding or retaining device.

The feeding mechanism may be arranged to be selectively actuated and deactuated, whereupon the apparatus may further comprise a device, such, for example, as a photoelectric device, for detecting the fact that the strap being accumulating within the stretch-out box has reached a predetermined level above the strap guide disposed at the upper position, and for temporarily deactuating the feeding mechanism when the detecting device has in fact detected the fact that the accumulated strap has reached the predetermined level. It is preferred that the feeding mechanism is arranged so as to feed the strap into the stretch-out box at a rate not less than and preferably greater than the rate at which the strapping head draws the strap out from the stretch-out box.

Preferably, the feeding mechanism comprises a pair of strap-feeding rollers which are arranged so as to engage a strap in a driving relationship with the strap and means for temporarily moving one of the rollers when it is desired to insert a strap between the rollers.

Additionally, such dispensing and accumulating apparatus may comprise an elongate, flexible, polymeric chute connected to the stretch-out box, near the strap outlet. The flexible chute is adapted to guide the strap between the strap outlet and the strapping machine of the type noted above.

Accordingly, such dispensing and accumulating apparatus according to a preferred embodiment of this invention can be effectively used to thread a strap into the strapping head of the strapping machine of the type noted above, whereby such apparatus may be conveniently described as a "self-threading" apparatus.

Thus, with the strap guide disposed at its lower position, the feeding mechanism is actuated so as to feed an indeterminate amount of the strap from a supply of the strap through the channel defined by means of the strap guide and the lower wall, along with the side walls of the stretch-out box, and through the flexible chute, into the strapping head. When the strap being fed into the strapping head encounters sufficient resistance, the strap is arrested at its leading end and begins to accumulate within the stretch-out box. The strap accumulating within the stretch-out box pivots the strap guide from its lower position toward its upper position. When the strap guide reaches its upper position, the holding device holds the strap guide at its upper position. When the strap accumulating within the stretch-out box reaches the predetermined level, the detecting device deactuates the feeding mechanism.

Subsequently, when the strapping machine is operated, the strapping head draws accumulated portions of the strap from the stretch-out box. When the strap accumulated within the stretch-out box is no longer at the predetermined level, the detecting device no longer deactuates the feeding mechanism, whereupon the feeding mechanism is again actuated so as to feed a further quantity of the strap into the stretch-out box. The strap guide continues to be releasably held at its upper position. Since the feeding mechanism is arranged to feed the strap into the stretch-out box at a greater rate as compared to the rate, at which the strapping head draws the strap out from the stretch-out box, the feeding mechanism feeds the strap into the stretch-out box until the strap accumulating within the stretch-out box again reaches the predetermined level, whereupon the detecting device again deactuates the feeding mechanism temporarily.

Subsequently, when the strapping head tensions the strap, the strapping head draws portions of the strap backwardly into the stretch-out box, within which the strap drawn backwardly into the stretch-out box accumulates along with the strap fed into the stretch-out box by means of the feeding mechanism.

These operations of such dispensing and accumulating apparatus according to a preferred embodiment of this invention are repeated, as the strapping machine is cycled from package to package, until the supply of the strap has been exhausted. A new supply of a similar strap may then be provided.

In an alternate embodiment of this invention, strap the dispensing and accumulating apparatus, which may be otherwise similar in other respects to the strap dispensing and accumulating apparatus described above, may comprise a strap snubber mounted upon the stretch-out box, near the strap outlet. The strap snubber is adapted to impart frictional resistance to the strap passing through the strap outlet. Preferably, the strap snubber is adjustable so as to impart adjustable levels of frictional resistance to the strap passing through the strap outlet.

Such dispensing and accumulating apparatus may be advantageously combined with a strapping machine of the type noted above, within a strapping system, particularly but not exclusively if such feeding and accumulating apparatus comprises a flexible chute, as described above.

In a preferred arrangement, the flexible chute has an inlet end connected to the stretch-out box, near the strap outlet, and an outlet end. Moreover, a bracket and a latch are used for connecting the outlet end of the flexible chute to the strapping head. The bracket is mounted upon the strapping head. The latch is movable between an opened position and a closed position and is adapted to latch the outlet end of the flexible chute to the bracket when moved to the closed position.

Furthermore, in the preferred arrangement, the outlet end of the flexible chute has at least one recess and at least one of the bracket and latch components is shaped so as to fit into the recess when the latch is moved to the closed position. Preferably, the outlet end of the flexible chute has two such recesses, the bracket being shaped so as to fit into one such recess and the latch being shaped so as to fit into the other recess.

BRIEF DESCRIPTION OF THE ILLUSTRATED EMBODIMENTS

These and other objects, features, and advantages of this invention will become evident from the following description of two illustrated embodiments of this invention, with reference to the accompanying drawings, in which like reference characters designate like or corresponding parts throughout the several views, and wherein:

FIG. 1 is an elevational view of a strap dispensing and accumulating apparatus according to a preferred embodiment of this invention.

FIG. 2, on an enlarged scale as compared to that of FIG. 1, is an exploded perspective detail showing a strap chute of such dispensing and accumulating apparatus, as associated with certain elements of a strapping head of a strapping machine.

FIG. 3, on an enlarged scale, compared as to that of FIG. 1, is a sectional view taken along line 3—3 of FIG. 1, in a direction indicated by means of the arrows, so as to show a strap being fed through a strap chute of such dispensing and accumulating apparatus.

FIG. 4 on a slightly larger scale as compared to that of FIG. 1, is a plan view of such dispensing and accumulating apparatus.

FIG. 5, on an enlarged scale as compared to that of FIG. 1, is a view taken partly in cross-section, along line 5—5 of FIG. 1, in a direction indicated by means of the arrows.

FIGS. 6 and 7 respectively are sectional views taken along line 7—7 of FIG. 5, in a direction indicated by means of the arrows, so as to show a clutch in a disengaged condition in FIG. 6 and in an engaged condition in FIG. 7.

FIG. 8 differs from FIG. 1 in that the strap guide shown in a lowered condition in FIG. 1 is shown in a raised condition in FIG. 8.

Figure 8:
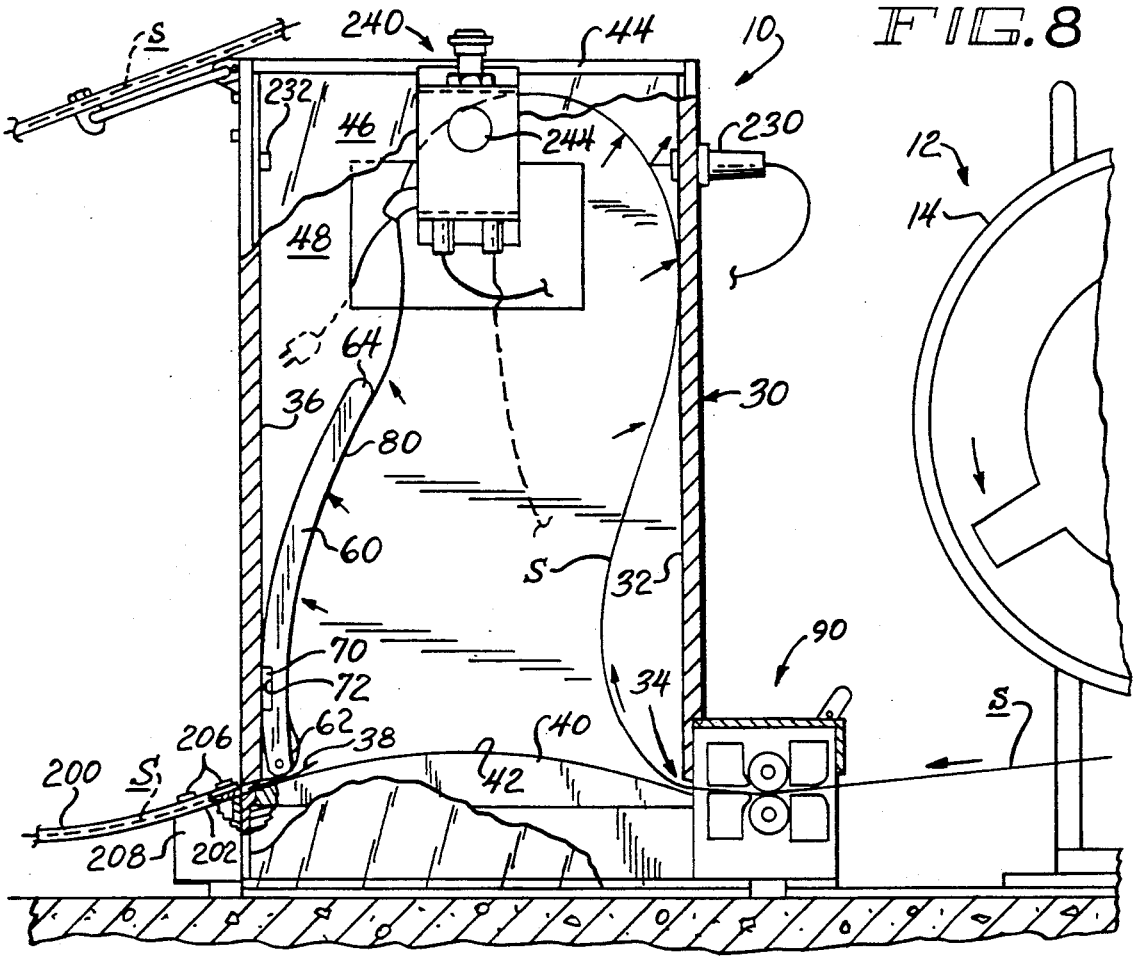
FIG. 8 is an enlarged detail view taken from FIG. 1.
Figure 10:
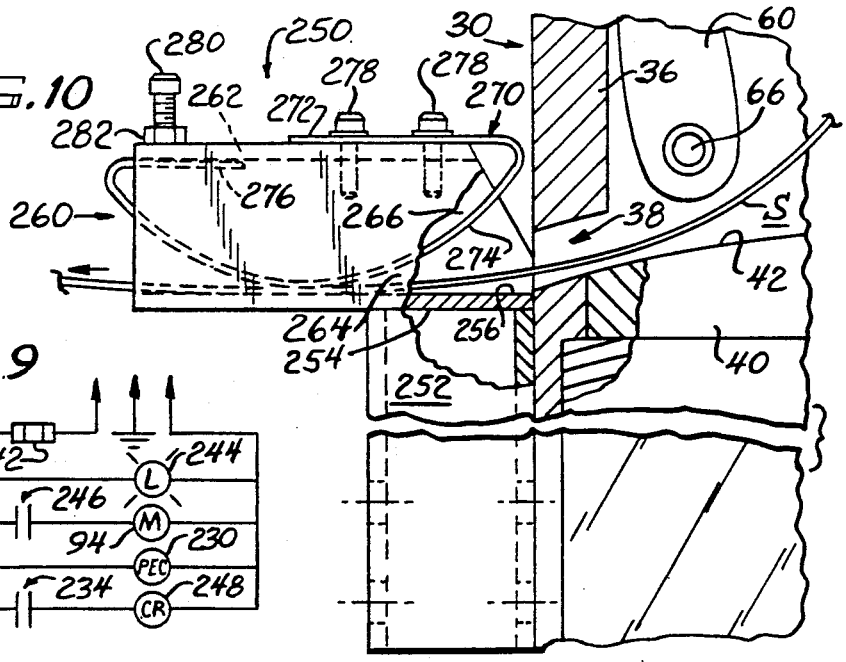

FIG. 10, on a larger scale as compared to that of FIG. 8, is a fragmentary detail of a certain elements of strap dispensing and accumulating apparatus constituting a simplified embodiment of this invention.

DETAILED DESCRIPTION OF ILLUSTRATED EMBODIMENTS

Figure 1:
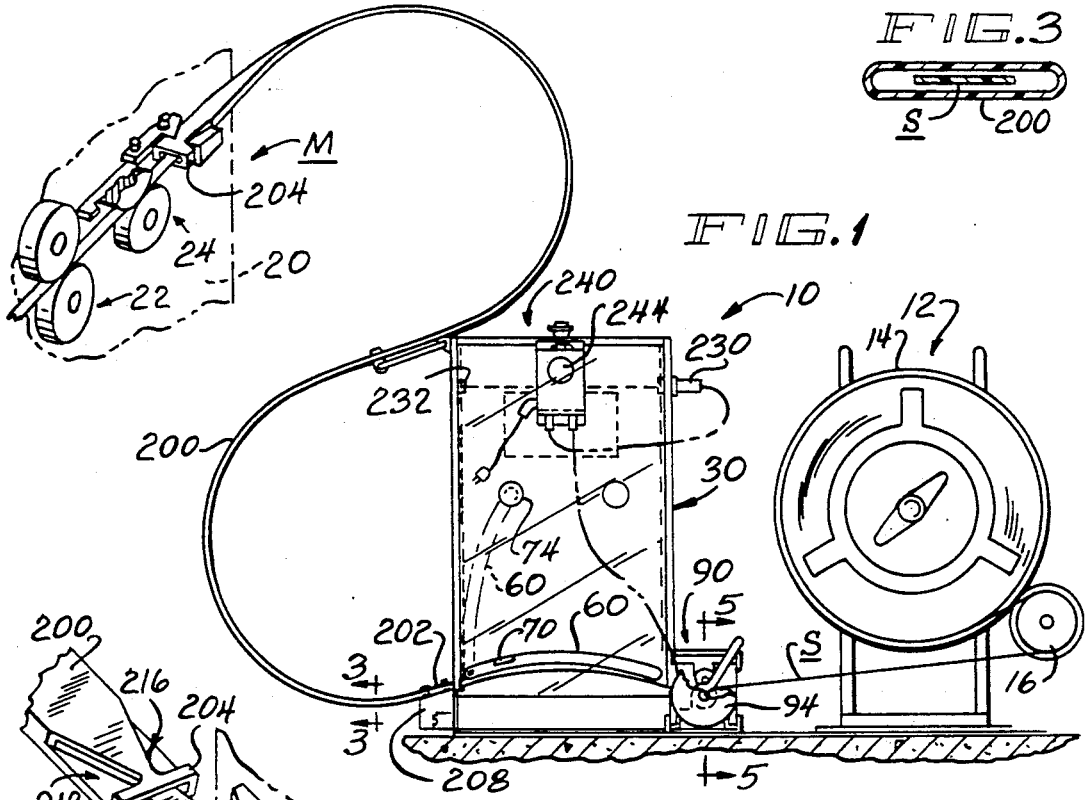

As shown in FIG. 1 and other views, the strap dispensing and accumulating apparatus 10 constitutes a preferred embodiment of this invention. The apparatus 10 utilizes a strap S of thermoplastic material, such as, for example, a polyester strap or a polypropylene strap, which is preferred. SIGNODE TM CONTRAX TM strap, as available commercially from Signode Industry Packing Systems, supra, is preferred.

Figure 4:
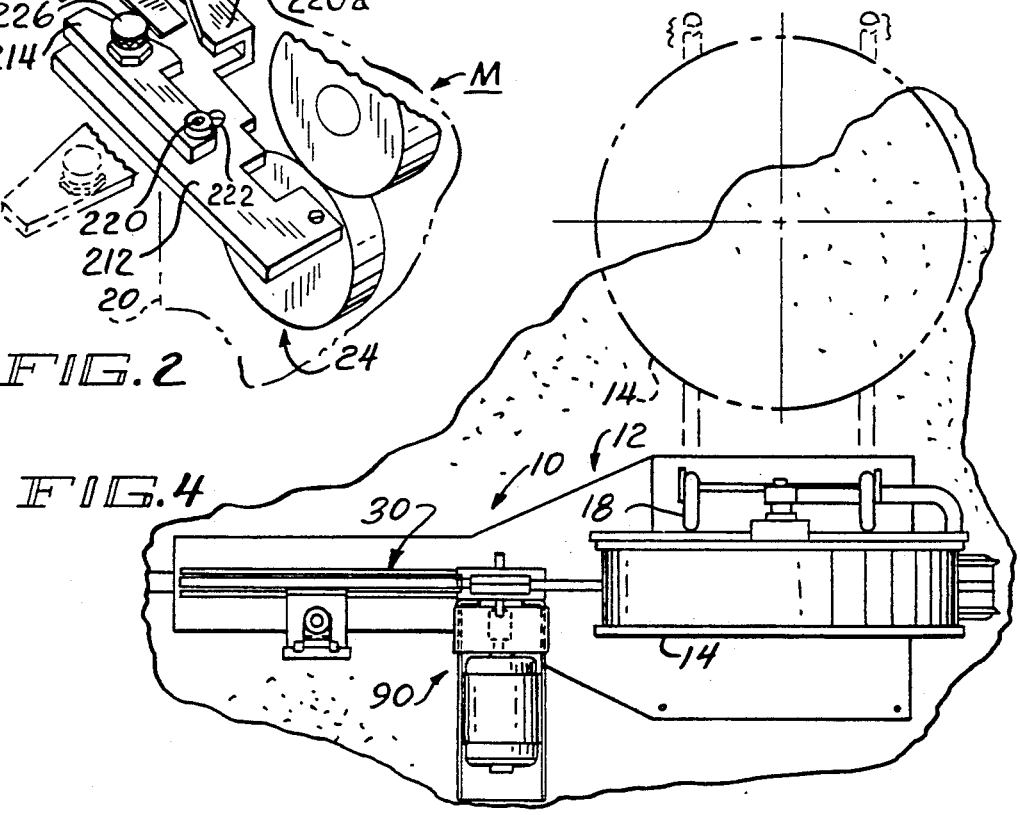

The strap S is supplied to the apparatus by means of and from a strap dispenser 12 including a supply reel 14, which holds a supply of the strap S of an indeterminate length, over a direction-changing roller 16. The strap dispenser 12 has spaced, pivotally mounted levers 18 enabling the supply reel 14 to be selectively pivoted between an operative position and an inoperative position. The supply reel 14 is shown, in FIG. 4, in the operative position in full lines and in the inoperative position in phantom lines. The supply reel 14 can thus be pivoted to the inoperative position when it is necessary to replace the supply reel 14 after the supply of the strap S upon the supply reel 14 has been exhausted. The strap dispenser 14 may be a SIGNODE TM Model DF-12D dispenser, as available commercially from Signode Industry Packaging Systems, supra.

Figure 2:
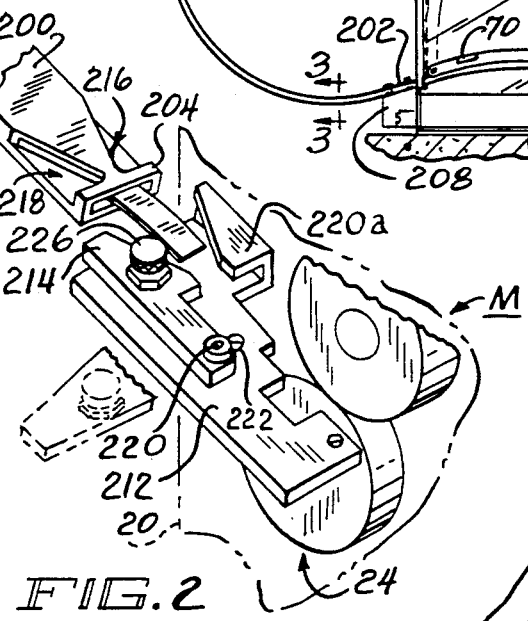

The strap S is supplied by means of and from the apparatus 10 to a strapping machine M including a strapping head 20, which is shown fragmentarily in FIGS. 1 and 2, of a known type. Except for certain elements of the strapping head 20, the strapping machine M is not shown. The strapping head 20 has two feeding rollers 22 and two tensioning or take-up rollers 24. When driven by means of the strapping head 20 in a known manner, the feeding rollers 22 draw the strap S forwardly at a given rate into the strapping machine M from the apparatus 10. The feeding rollers 22 are arranged to be selectively disengaged from the strap S, in a known manner, so as to enable the strap S to be drawn backwardly by means of the tensioning rollers 24. When driven by means of the strapping head 20 in a known manner, the tensioning rollers 24 draw the strap S backwardly at a similar rate from the strapping machine M into the apparatus 10. The tensioning rollers 24 are arranged to be selectively disengaged from the strap S, in a known manner, so as to enable the strap S to be drawn forwardly by means of the feeding rollers 22.

Thus, the strapping head 20 is operable, in a known manner, to feed the strap S around a package (not shown) by means of a strap chute (not shown) when the feeding rollers 22 are driven with the tensioning rollers 24 disengaged from the strap S. Also, the strapping head 20 is operable, in a known manner, so as to tension the strap S in a tensioned loop around the package when the tensioning rollers 24 are driven with the feeding rollers 22 disengaged from the strap S. Moreover, the strapping head 20 is operable in a known manner, so as to weld the strap S in the tensioned loop state around the package and to sever the strap S in the tensioned loop state from those residual portions of the strap S following or upstream of the tensioned loop. The strapping machine M including the strapping head 20 may be a SIGNODE TM SPIRIT TM Model BCU strapping machine including a SIGNODE TM SPIRIT TM strapping head, as available commercially from Signode Industry Packaging Systems, supra.

The apparatus 10 comprises a stretch-out box 30 having an end wall 32 defining a strap inlet 34 and an end wall 36 defining a strap outlet 38, as been seen in FIG. 8. Also, the stretch-out box 30 has a lower wall 40 defining a guiding surface 42, an upper wall 44, and two side walls 46, 48, in parallel relation with respect to each other. So as to enable a user to observe the strap S and other elements within the stretch-out box 30, one of the side walls, namely the side wall 46, is made of a transparent material, such as, for example, glass or polycarbonate, which is preferred. The distance between the side walls 46, 48, is slightly greater than the width of the strap S. The guiding surface 42 is arched, as shown, and extends between a lower edge of the strap inlet 34 and a lower edge of the strap outlet 38.

The apparatus 10 comprises an elongate, substantially rigid strap guide 60 having two opposite ends 62, 64, which are rounded, as shown. The strap guide 60 is pivotally mounted between the side walls 46, 48, near the strap outlet 38, by means of a pivot pin 66 extending through the strap guide 60, near the strap guide end 62, and defining an axis, about which the strap guide 60 is pivotable. The strap guide 60 is pivotable between an upper, inoperative position, in which it is shown in phantom lines in FIG. 1 and in full lines in FIG. 8, and a lower, operative position, in which it is shown in full lines in FIG. 1. The strap guide 60 is biased gravitationally toward the lower position.

The end wall 36 defining the strap outlet 38 is made of a magnetizable material, such as, for example, carbon steel, which is preferred. A permanent magnet 70 is mounted by means of screws (not shown) within a recess 72 defined within the strap guide 60. The permanent magnet 70 coacts with the end wall 36 so as to releasably retain or hold the strap guide 60 in the upper position. The side wall 46 made of a transparent material has an aperture 74 (see FIG. 1) defining therein for enabling a user to manually release the strap guide 60 from the upper position, by inserting one of his or her fingers or a small tool (not shown) into and through the aperature 74 and pushing the strap guide 60 therewith so as to separate the permanent magnet 70 of the strap guide 60 from the end wall 36. As a result of being biased gravitationally, the strap guide 60 tends to pivot toward the lower position after it has been released from the upper position.

The strap guide 60 has a guiding surface 80, which comprises its lower surface when the guide 60 is disposed at its lower position. The guiding surface 80 conforms to the guiding surface 42 of the lower wall 40 and overlies such surface 42 when the strap guide 60 is disposed at its lower position. When disposed at its lower position, the strap guide 60 coacts with the lower wall 40, along with the side walls 46, 48, so as to define a channel between the guiding surface 80 of the strap guide 60 and the guiding surface 42 of the lower wall 40, and between the side walls 46, 48, for guiding the strap S when the strap S is fed into the stretch-out box 30, by means of the strap inlet 34. The strap S is guided, within the channel defined thereby, from the strap inlet 34 to the strap outlet 38.

Figure 5:
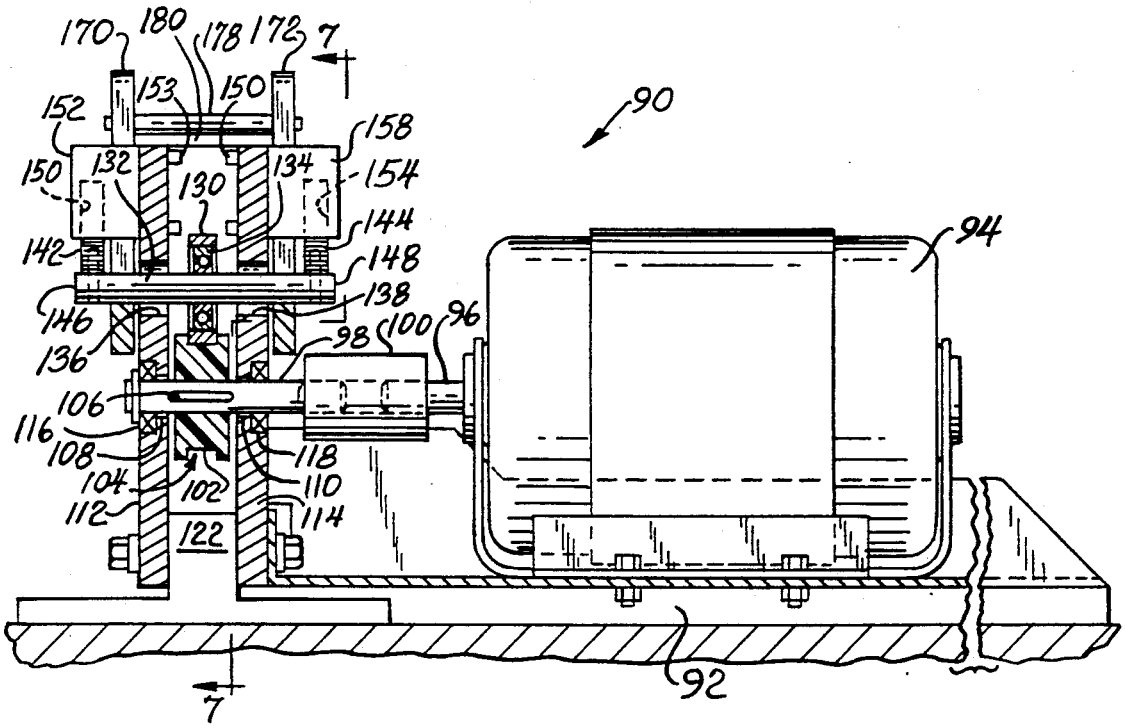
Figure 6:
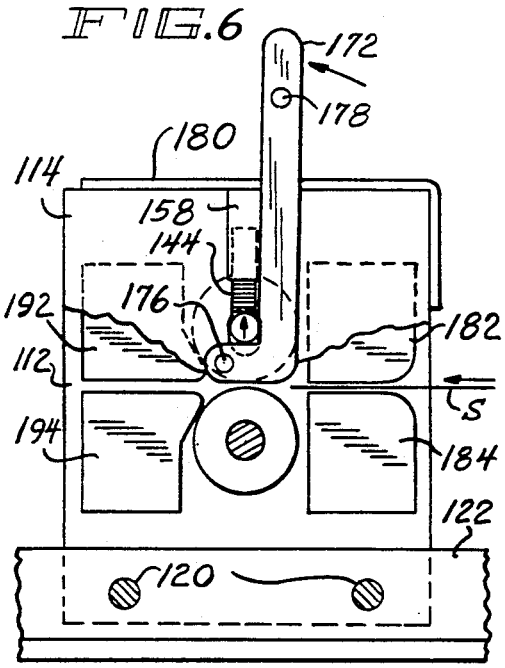
Figure 7:
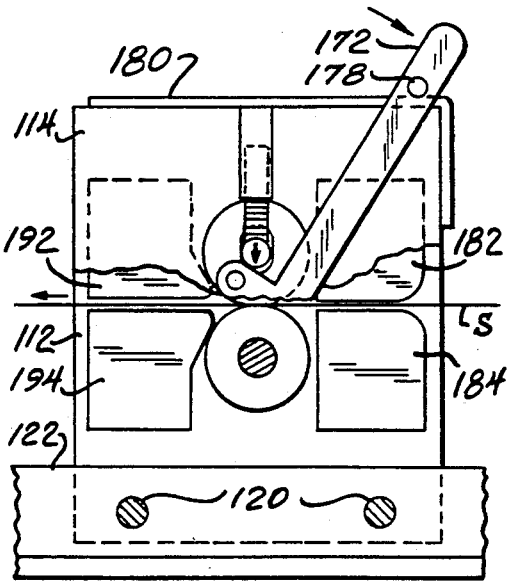

As shown primarily in FIGS. 5, 6, and 7, the apparatus 10 further comprises a mechanism 90 for feeding the strap S from the strap dispenser 12, over the direction-changing roller 16, into and the stretch-out box 30, by means of the strap inlet 34. The feeding mechanism 90 is arranged so as to feed the strap S into the stretch-out box 30 at a faster rate as compared to the given rate at which the strapping head 20 draws the strap S out from the stretch-out box 30. The mechanism 90 comprises a base 92, on which a fractional horsepower, alternating-current motor 94 is mounted. The motor 94 has a shaft 96, which is driven by means of the motor 94, and to which a shaft 98 is coupled for conjoint rotation, by means of a coupler 100. A polyurethane-coated roller 102 having a strap groove defined within an outer peripheral portion thereof is mounted upon the roller shaft 98 for conjoint rotation, by means of a key 106 fitting into keyways defined within the roller 102 and within the shaft 98. The strap groove 104 accommodates the strap S engaging the roller 102. The shaft 98 extends through aligned apertures 108, 110, defined within two upright plates 112, 114, and is journalled within annular bearings 116, 118, which are mounted within the aligned apertures 108, 110. The upright plates 112, 114, are mounted by means of screws 120, to a bracket 122, which is mounted to the base 92.

A steel roller 130 is journalled upon a shaft 132, by means of a roller bearing 134, which is mounted within the roller 130 and around the shaft 132. The shaft 132 extends through an aperture 136 defined within the upright plate 112 and through an aperture 138 defined within the upright plate 114. The apertures 136, 138, are shaped so as to permit the shaft 132 to translate freely within the apertures 136, 138, and so as to permit the shaft 132 to be vertically displaced between an upper position and a lower position. The shaft 132 is shown at its lower position at FIG. 7 and in an intermediate position in FIGS. 5 and 6. The steel roller 130 fits loosely into the strap groove 104 of the polyurethane-coated roller 102 and overlies the strap S disposed within the strap groove 104.

The shaft 132 is biased toward its lower position by means of two coiled springs 142, 144, which bear against the shaft 132, near its opposite ends 146, 148. The coiled spring 142 is retained, at its upper end, within a socket 150 opening downwardly within a block 152, which is mounted upon the upright plate 112 by means of screws 153. The coiled spring 144 is retained, at its upper end, within a socket 154 opening downwardly within a block 158, which is mounted upon the upright plate 114 by means of screws 160.

A pair of manually actuatable levers 170, 172, are provided, which enable a user to temporarily raise the shaft 132 from its lower position. The lever 170 is pivotally mounted upon to the upright plate 112, by means of a pivot pin (not shown) so as to engage the shaft 132 between the coiled spring 142 and the upright plate 112. The lever 172 is pivotably mounted upon to the upright plate 114, via a pivot pin 176, so as to engage the shaft 132 between the coiled spring 144 and the upright plate 114. The levers 170, 172 are connected by means of a rod 178. The rod 178 is arranged so as to engage a flanged plate 180, which is mounted upon the upright plates 112, 114, so as to limit the pivotal movement of the levers 170, 172, in each direction.

Strap-guiding blocks 182, 184, which are mounted between the upright plates 112, 114, in front of the rollers 102, 130, define a narrow passage, which facilitates threading the strap S initially into the mechanism 90 from the strap dispenser 12. Strap-guiding blocks 192, 194, which are mounted between the upright plates 112, 114, in back of the rollers 102, 130 and in front of the strap inlet 34 of the stretch-out box 30, facilitate feeding the strap S from the mechanism 90 into the stretch-out box 30.

Figure 3:
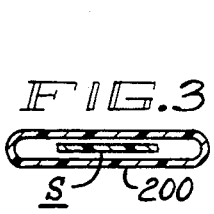

An elongate, flexible chute 200 having an inlet end 202 and an outlet end 204 and comprising an elongate, flexible, polymeric tube, which is flattened so as to have an oblong cross-section as shown in FIG. 3, is connected between the stretch-out box 30 and the strapping machine 20. The inlet end 202 of the chute 200 is connected by means of shoulder bolts 206 to a bracket 208, which is mounted upon the stretch-out box 30, near the strap outlet 38. The outlet end 204 of chute 200 is connected to the strapping machine 20, by means of a bracket 212 and a latch 214 as seen in FIG. 2. The chute 200 is connected so as to guide the strap S when the strap S is drawn by means of the feeding rollers 22 forwardly into the strapping machine 20 from the stretch-out box 30 and when the strap S is drawn by means of the tensioning rollers 24 backwardly into the stretch-out box 30 from the strapping machine 20.

The bracket 212 is mounted upon the strapping machine 20, near the feeding rollers 22. The outlet end 204 of the chute 200 has two triangular recesses 216, 218, as shown in FIG. 2. The triangular recess 216 accommodates a triangular flange 220, which is provided upon the bracket 212, and the triangular recess 218 accommodates a triangular portion 222 of the latch 214. The latch 214 is pivotally mounted upon to the bracket 212, by means of a pivot pin 220 which fits within an elongate slot 222, defined within the bracket 212. The elongate slot 222' enables the pivot pin 220 to be adjustably located with respect to bracket 212. Thus, the latch 214 is mounted for pivotal movement between a closed position and an opened position. The latch 214 is shown, in FIG. 2, in its closed position in full lines and in its opened position in phantom lines. A thumb screw 226, which is carried by means of the latch 214, is arranged so as to be manually turned in a clockwise direction (as shown) until it bears against the bracket 212, in the closed position of the latch 214, when it is desired to latch the outlet end 204 of the chute 200 to the bracket 212. The thumb screw 226 is arranged to be oppositely turned when it is desired to pivot the latch 214 to the opened position so as to release the outlet end 204 of the chute 200 from the bracket 212.

A photoelectric cell 230 is mounted upon the upper end of the end wall 32, near the upper wall 44, so as to be enclosed within the stretch-out box 30. A reflector 232 is mounted upon the end wall 34, near the upper wall 44, in opposed relation to the photoelectric cell 230. The photoelectric cell 230 is operable in a known manner so as to transmit a beam toward the reflector 232, at a predetermined level above the strap guide 60 when the same is disposed at the upper position, and to receive the beam, as reflected by means of the reflector 232, unless the beam is interrupted by means of the strap S within the stretch-out box 230. Because the strap guide 60 is below the beam level even when the strap guide 60 is disposed at its upper position, the strap guide 60 does not interrupt the beam. As shown schematically in FIG. 9, the photoelectric cell 230 is arranged in a known manner so as to control a pair of contacts 234 in such a manner that the contacts 234 are closed except when the beam is interrupted and in such a manner that the contacts 234 are opened when the beam is interrupted.

Figure 9:
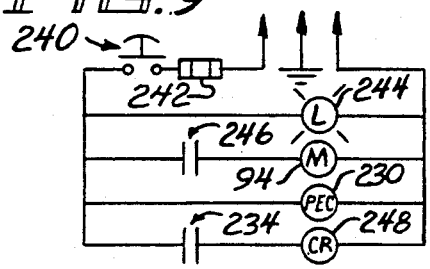
FIG. 9 is a schematic diagram of the various electrical components of the apparatus shown in FIG. 1 and other views.

A manually actuatable, push-to-close, pull-to-open switch 240 is mounted upon the side wall 46, near the upper wall 44, and is connected by means of a fuse 242 (see FIG. 9) to a source of electrical power. A lamp 244 is connected to the switch 240 so as to indicate when the switch 240 is closed. As shown in FIG. 9, the motor 94 is also connected to the switch 240, by means of a pair of contacts 246, which are controlled by means of a relay 248. Moreover, the relay 248 is connected to the switch 240, by means of the contacts 234 controlled by means the photoelectric cell 230. Consequently, the motor 94 is enabled when the switch 240 is closed, unless the contacts 234 are opened by means of the photoelectric cell 230.

Accordingly, such dispensing and accumulating apparatus can be effectively used to thread the strap S from the strap dispenser 12 into the strapping head 20 of the strapping machine M. Initially, the strap guide 60 is pivoted to its lower position. Thereupon, the levers 170, 172, are operated manually so as to temporarily raise the shaft 132 from its lower position, the strap S is inserted, at its leading end, into the strap groove 104 of the polyurethane-coated roller 102 and below the steel roller 130, and the levers 170, 172, are released so that the strap S is pressed tightly within the strap groove 104 by means of the steel roller 130, which is biased by means of the coiled springs 142, 144, bearing against the shaft 132. Next, the switch 240 is pressed, so as to actuate the motor 94 of the feeding mechanism 90. When the motor 94 is actuated, the polyurethane-coated roller 102 is driven and coacts with the steel roller 130 so as to feed the strap S through the channel defined by means of the strap guide 60 and the lower wall 40, along with the side walls 46, 48, and through the flexible chute 200, into the strapping head 20. Within the strapping head 20, the feeding rollers 22 and the tensioning rollers 24 are disengaged, so as to permit the strap S to be fed into the strapping head 20.

When the strap S being fed into the strapping head 20 encounters sufficient resistance, the strap S is arrested at its leading end and begins to accumulate within the stretch-out box 30. The strap S accumulating within the stretch-out box 30 pivots the strap guide 60 from its lower position toward its upper position. When the strap S accumulating within the stretch-out box 30 reaches a predetermined level where the strap S interrupts the beam transmitted by means of the photoelectric cell 230 and reflected by means of the reflector 232, the photoelectric cell 230 opens the contacts 234 so as to temporarily deactuate the motor 94 of the feeding mechanism 90.

Subsequently, when the strapping machine M is operated, the feeding rollers 22 of the strapping head 20 are engaged with the strap S and are driven so as to draw accumulated portions of the strap S out from the stretch-out box 30 and into the strapping head 20. The tensioning rollers 24 are disengaged from the strap S when the strap S is drawn into the strapping head 20. When the strap S accumulated within the stretch-out box 30 is no longer at the predetermined level at which the strap S interrupts the beam transmitted by means of the photoelectric cell 230 and reflected by means of the reflector 232, the photoelectric cell 230 closes the contacts 234 so as to enable the motor 94 of the feeding mechanism 90 to again be actuated, whereupon the feeding mechanism 90 feeds a further quantity of the strap S into the stretch-out box 30.

Since the feeding mechanism 90 is arranged to feed the strap S into the stretch-out box 30 at a faster rate as compared to the given rate at which the strapping head 20 draws the strap S out from the stretch-out box 30, the feeding mechanism 90 feeds the strap S into the stretch-out box 30 until the strap S accumulating within the stretch-out box 30 again reaches the predetermined level at which the strap S interrupts the beam emitted by means of the photoelectric cell 230 and reflected by means of the reflector 232, whereupon the photoelectric cell 230 again opens the contacts 234 so as to temporarily deactuate the motor 94 of the feeding mechanism 90.

Thereupon, when the strapping head 20 tensions the strap S, the tensioning rollers 24 of the strapping head 20 are engaged with the strap S and are driven so as to draw an excess quantity of the strap S back through the strapping head 20 and into the stretch-out box 30. The feeding rollers 22 are disengaged from the strap S when the strap S is drawn back through the strapping head 20. The strap S drawn from the strapping head 20 and into the stretch-out box 30 accumulates within the stretch-out box 30, along with the portion of the strap S fed into the stretch-out box 30 by means of the feeding mechanism 90, as controlled by means of the photoelectric cell 230.

These operations of such dispensing and accumulating apparatus are repeated, as the strapping machine M is cycled from package to package, until the supply of the strap S upon the supply reel 14 of the strap dispenser 12 has been exhausted. The supply reel 14 may then be replaced with a similar reel holding a new supply of a similar strap.

In an alternate embodiment of this invention, as shown in FIG. 10, the flexible chute 200 is omitted and the apparatus 10 is provided with a strap snubber 250, which is not used in the preferred embodiment. The strap snubber 250 is mounted upon a bracket 252, which is mounted upon the stretch-out box 30, near the strap outlet 38. The bracket 252 includes upper plate 254 defining a guiding surface 256, which is the upper surface of the upper plate 254.

The strap snubber 250 comprises a bracket 260 having a top wall 262, and having two side walls 264, 266. Also, the strap snubber 250 comprises a blade 270, which is made of spring steel. The blade 270 is shaped, as shown, so as to define a mounting portion 272, a curved portion 274, and a distal portion 276. The mounting portion 272 overlies the top wall 262 of the bracket 260 and is mounted upon the top wall 262 by means of screws 278. The curved portion 274 is disposed so as to press a portion of the strap S against the guiding surface 256 of the bracket 252, so as to impart frictional resistance to the strap S passing in either direction through the strap outlet 38. The distal portion 276 extends beneath the top wall 262. An adjusting screw 280 having a nut 282 threaded thereon is threaded through a threaded aperture 284 defined within the top wall 262, so as to bear against the distal portion 276. The adjusting screw 280 may be manually adjusted to different positions, in which the adjusting screw 280 may then be secured by means of the nut 282, so that the blade 270 can impart adjustable levels of frictional resistance to the strap S passing in either direction through the strap outlet 38.

It is convenient to refer to the strap dispensing and accumulating apparatus according to the preferred embodiment described above as "self-threading" and to refer to such apparatus according to the alternate embodiment described above as "auto-feeding". Various changes may be made to either embodiment without departing from the scope and spirit of this invention. It is therefore to be understood that within the scope of the appended claims, the present invention may be practiced otherwise than as specifically described herein.

I claim:

1. Strap dispensing and accumulating apparatus to be used with a strap of thermoplastic material and with a strapping machine having a strapping head operable at certain times so as to draw portions of said strap forwardly into said strapping machine and at other times to draw portions of said strap backwardly from said strapping machine, said dispensing and accumulating apparatus also being used to accumulate strap portions before those portions are drawn by said strapping head into said strapping machine, to accumulate strap portions drawn by said strapping head from said strapping machine, and to dispense accumulated strap portions of said strap to said strapping head, said dispensing and accumulating apparatus comprising:

a stretch-out box having a strap inlet and a strap outlet and including two side walls disposed in a parallel relationship with respect to each other and a lower wall defining a guiding surface between said strap inlet and said strap outlet;

a strap guide disposed between said side walls of said stretch-out box and movable between a lower, operative position and an upper, inoperative position, said strap guide having a guiding surface, which overlies said guiding surface of said lower wall of said stretch-out box when disposed in said lower position, so as to extend between said strap inlet and said strap outlet and to define with said guiding surface of said lower wall of said stretch-out box a guide channel for guiding said strap being fed into said stretch-out box through means of said strap inlet and for guiding said strap as said strap moves from said strap inlet toward said strap outlet; and means for feeding said strap from a supply of said strap in an indeterminate length amount into said stretch out box by means of said strap inlet.

2. The apparatus of claim 1 wherein the strap guide is an elongate member having two opposite ends and is mounted pivotally between the side walls, near the strap outlet, for pivotal movement about an axis near one of the opposite ends of the strap guide, in such manner that the strap guide is pivotable between the lower and upper positions.

3. The apparatus of claim 2 further comprising means for holding the strap guide releasably in the upper position.

4. The apparatus of claim 2 further comprising magnetic means for holding the strap guide releasably in the upper position.

5. The apparatus of claim 4 wherein one of the side walls has an aperture enabling a user manually to release the strap guide from the upper position.

6. The apparatus of claim 1 with the feeding means arranged to be selectively actuated and de-actuated, said apparatus further comprising means for detecting when a strap accumulating in the stretch-out box has reached a predetermined level, and for de-actuated the feeding means temporarily when the detecting device has detected that the accumulating strap has reached the predetermined level.

7. The apparatus as set forth in claim 6, wherein:

one of said side walls of said stretch-out box is transparent so as to permit one to visually observe the accumulated exent of said strap within said stretch-out box.

8. The apparatus of claim 1 with the feeding means arranged to be selectively actuated and de-actuated, said apparatus further comprising photoelectric means for detecting when a strap accumulating in the stretch-out box has reached a predetermined level above the strap guide in the upper position, and for de-actuated the feeding means when the detecting means has detected that the accumulating strap has reached the predetermined level.

9. The apparatus of claim 1 further comprising an elongate flexible, polymeric chute connected to the stretch-out box, near the strap outlet, the flexible chute being adapted to guide said strap between the strap outlet and said strapping machine.

10. The apparatus of claim 1 wherein the feeding means comprises a pair of strap-feeding rollers arranged to engage a strap in a driving relationship with the strap and means for moving one of the rollers temporarily when it is desired to insert a strap between said rollers.

11. The apparatus of claim 1 further comprising a strap snubber mounted to the stretch-out box, near the strap outlet, the strap snubber being adapted to impart frictional resistance to said strap passing through the strap outlet.

12. The apparatus of claim 11 wherein the strap snubber is adjustable so as to impart adjustable levels of frictional resistance to said strap passing through the strap outlet.

13. In a strapping system to be used with a strap of thermoplastic material, a combination comprising a strapping machine having a strapping head operable at certain times so as to draw portions of said strap forwardly into said strapping machine and at other times to draw portions of said strap backwardly from said strapping machine, and a strap dispensing and accumulating apparatus to be used to accumulate strap portions before those portions are drawn into said strapping machine, to accommodate strap portions drawn from said strapping machine, and to dispense the accumulated portions of said strap to said strapping head, said dispensing and accumulating apparatus comprising:

a stretch-out box having a strap inlet and a strap outlet and including two side walls disposed in a parallel relationship with respect to each other, and a lower wall defining a guiding surface between said strap inlet and said strap outlet;

a strap guide disposed between said side walls of said stretch-out box and movable between a lower, operative position and an upper, inoperative position, said strap guide having a guiding surface, which overlies said guiding surface of said lower wall of said stretch-out box when disposed in said lower position, so as to extend between said strap inlet and said strap outlet and to define with said guiding surface of said lower wall of said stretch-out box a guide channel for guiding said strap being fed into said stretch-out box through means of said strap inlet and for guiding said strap as said strap moves form said strap inlet toward said strap outlet; and means for feeding said strap from a supply of said strap in an indeterminate length amount into said stretch-out box by means of said strap inlet.

14. The combination of claim 13 wherein the strap guide is an elongate member having two opposite ends and is mounted pivotally between the side walls, near the strap outlet, for pivotal movement about an axis near one of the opposite ends of the strap guide, in such manner that the strap guide is pivotable between the lower and upper positions, said apparatus further comprising means for holding the strap guide releasably in the upper position.

15. The combination of claim 13 with the feeding means arranged to be selectively actuated and de-actuated, said apparatus further comprising means for detecting when a strap accumulating in the stretch-out box has reached a predetermined level above the strap guide in the upper position, and for de-actuating the feeding means when the detecting means has detected that the accumulating strap has reached the predetermined level.

16. The combination of claim 13 with the feeding means arranged to be selectively actuated and de-actuated, said apparatus further comprising photoelectric means for detecting when a strap accumulating in the stretch-out box has reached a predetermined level above the strap guide in the upper position, and for de-actuating the feeding means when the detecting means has detected that the accumulating strap has reached the predetermined level.

17. The combination of claim 13 further comprising an elongate, flexible, polymeric chute connected to the stretch-out box, near the strap outlet, the flexible chute being adapted to guide said strap between the strap outlet and the strapping head.

18. The combination of claim 17 wherein the flexible chute has an inlet end connected to the stretch-out box, near the strap outlet, and an outlet end connected to the strapping head, wherein said combination comprises means including a bracket and a latch for connecting the outlet end of the flexible chute to the strapping head, the bracket being mounted to the strapping head, the latch being movable between an opened position and a closed position and being adapted to latch the outlet end of the flexible chute to the bracket when moved to the closed position, and wherein the outlet end of the flexible chute has at least one recess and at least one of the bracket and the latch is shaped so as to fit into the recess when the latch is moved to the closed position.

19. The combination of claim 18 wherein the outlet end of the flexible chute has two such recesses, wherein the bracket is shaped so as to fit into one of said recesses, and wherein the latch is shaped so as to fit into the other recess.

20. The combination of claim 13 wherein the strapping head is arranged to draw the strap forwardly at a given rate and wherein the feeding means is arranged to feed the strap into the stretch-out box at a faster rate.

* * * * *